US006062034A

United States Patent [19]

Nakanuma

[11] Patent Number: 6,062,034

[45] Date of Patent: May 16, 2000

[54] SEPARATE TYPE AIR CONDITIONER AND ASSEMBLING METHOD OF INDOOR UNIT

[75] Inventor: Mitsuo Nakanuma, Shiga, Japan

[73] Assignee: Matsushita Electric Industrial Co., Ltd., Osaka, Japan

[21] Appl. No.: 09/211,403

[22] Filed: Dec. 15, 1998

[30] Foreign Application Priority Data

Dec. 15, 1997 [JP] Japan ..... 9-363638

[51] Int. Cl.[7] ..... F25D 19/00

[52] U.S. Cl. ..... 62/298; 62/263

[58] Field of Search ..... 62/298, 263, 262, 62/77

[56] References Cited

U.S. PATENT DOCUMENTS

| | | | |
|---|---|---|---|
| 4,240,264 | 12/1980 | Nakada et al. | 62/125 |
| 5,191,770 | 3/1993 | Kim | 62/263 |
| 5,361,981 | 11/1994 | Albert et al. | 236/42 |
| 5,388,426 | 2/1995 | Wada et al. | 62/263 |
| 5,664,428 | 9/1997 | Sugiyama et al. | 62/259.1 |

FOREIGN PATENT DOCUMENTS

| | | | |
|---|---|---|---|
| 60-259844 | 12/1985 | Japan | 62/262 |
| 5-164355 | 6/1993 | Japan . | |
| 5-180461 | 7/1993 | Japan | 62/298 |
| 6-2879 | 1/1994 | Japan | 62/298 |

*Primary Examiner*—Henry Bennett
*Assistant Examiner*—Meluin Jones
*Attorney, Agent, or Firm*—Ratner & Prestia

[57] ABSTRACT

The constitution has (a) an outdoor unit, and (b) an indoor unit including a wind circuit unit having an air suction port, a heat exchanger and blowing means, an air stream control unit having an air diffuser and air stream control means, and an electrical unit having an electric control device and an electric circuit. At least one of the wind circuit unit, the air stream control unit, and the electrical unit is formed separately, and the one unit and the remaining units of the plurality of units are mutually assembled integrally to form the indoor unit. The indoor unit composed of the wind circuit unit, air stream control unit, and electrical unit possesses a front surface having a continuous pattern. In this constitution, it is possible to obtain an indoor unit of an air conditioner having such effects as excellent appearance, small number of parts, enhanced ease of disassembling, excellent working efficiency in mounting, and excellent working efficiency in repair service. Moreover, in model changeover, by modifying the individual units of the wind circuit unit, air stream control unit and electrical unit according to the purpose, restyling is easier. Hence, expenses for making dies for producing the units are saved, so that the manufacturing cost is reduced.

15 Claims, 6 Drawing Sheets

SEPARATE TYPE AIR CONDITIONER AND ASSEMBLING METHOD OF INDOOR UNIT

FIELD OF THE INVENTION

The present invention relates to a separate type air conditioner consisting of an indoor unit and an outdoor unit which are separate from each other. In particular, the invention relates to a method of assembling the indoor unit.

BACKGROUND OF THE INVENTION

An example of a conventional air conditioner is shown in Japanese Laid-open Patent No. 5-164355. A conventional separate type air conditioner is described below while referring to the drawings. A perspective view showing the constitution of an indoor unit of the conventional separate type air conditioner is shown in FIG. 6. In FIG. 6, an indoor unit main body 21 includes a wind circuit unit 22 and an air stream control unit 23. The wind circuit unit 22 has a refrigeration cycle unit such as heat exchanger, a blowing fan and others. An electrical unit 24 is installed separately from the indoor unit main body 21. The electrical unit 24 is connected electrically to the indoor unit main body 21 through a connection unit 25 exposed outside. In such a conventional separate type air conditioner, the indoor unit main body 21 and electrical unit 24 are mutually connected electrically through the connection unit 25 exposed outside. Accordingly, such a conventional air conditioner is poor in outlook and appearance as the merchandise on the whole. Moreover, since the indoor unit main body 21 and electrical unit 24 are formed separately as independent parts through the connection unit 25, it takes time and labor to install the merchandise. Further, since additional members are necessary for mounting the indoor unit main body 21 and electrical unit 24, the number of steps for mounting and number of parts are increased.

It is hence an object of the invention to present an indoor unit of an air conditioner having such effects as excellent appearance, small number of parts, enhanced ease of disassembling, excellent working efficiency in mounting, and excellent working efficiency in repair service.

SUMMARY OF THE INVENTION

A separate type air conditioner of the invention comprises (a) an outdoor unit, and (b) an indoor unit including a wind circuit unit having an air suction port, an air stream control unit having an air diffuser, and an electrical unit having an electric control device, in which at least one unit of the wind circuit unit, the air stream control unit, and the electrical unit is formed separately, and the one unit and the remaining units of the plurality of units are mutually assembled integrally to form the indoor unit.

An assembling method of the separate type air conditioner of the invention comprises (a) a step of assembling an outdoor unit, and (b) a step of assembling an indoor unit consisting of a plurality of units, that is, (i) a wind circuit unit having an air suction port, (ii) an air stream unit having an air diffuser, and (iii) an electrical unit having an electric control device. The indoor unit assembling step includes forming at least one of said units (i), (ii), and (iii) separately and then integrating units (i), (ii), and (iii) to form the indoor unit.

In this constitution, it is possible to obtain an indoor unit of an air conditioner having such effects as excellent appearance, small number of parts, enhanced ease of disassembling, excellent working efficiency in mounting, and excellent working efficiency in repair service. Moreover, without sacrificing the outlook of the merchandise on the whole, these excellent effects are obtained. In model changeover, by modifying the individual units of the wind circuit unit, air stream control unit and electrical unit according to the purpose, restyling is easier. Hence, expenses for making dies for producing the units are saved, so that the manufacturing cost is reduced.

REFERENCE NUMERALS

Figure 1:
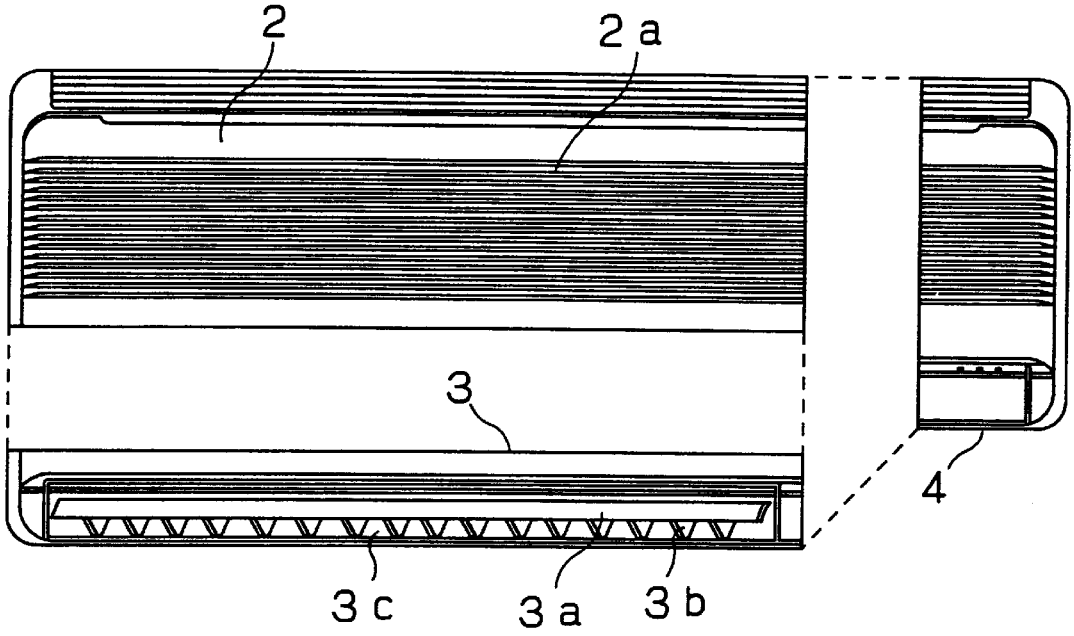
FIG. 1(*a*) and FIG. 1(*b*) are drawings showing an indoor unit in accordance with an exemplary embodiment of the present invention, in which FIG. 1(*a*) shows separate units, and FIG. 1(*b*) shows assembled units.
Figure 1:
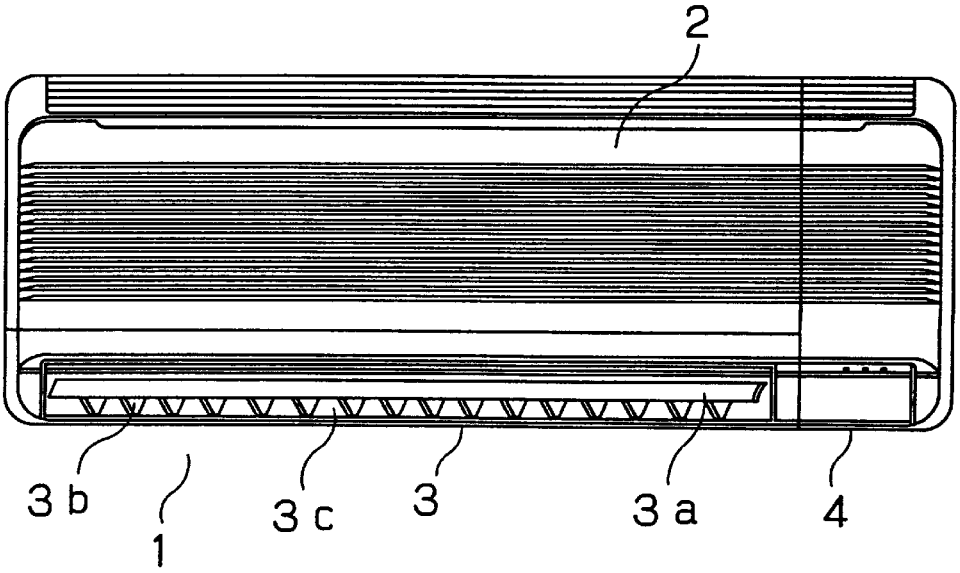

1 Indoor unit main body
2 Wind circuit unit
2*a* Air suction port
3 Air stream control unit
3*a* Vertical blade (air stream control means)
3*b* Lateral blade (air stream control means)
3*c* Air diffuser
4 Electrical unit
30 Outdoor unit
31 External piping

DETAILED DESCRIPTION OF THE INVENTION

A separate type air conditioner of the invention comprises (a) an outdoor unit, and (b) an indoor unit including a wind circuit unit having an air suction port, an air stream control unit having an air diffuser, and an electrical unit having an electric control device for controlling air conditioner (e.g. motor speed, vent position, compressor, heat exchanger) operation (including, for example, switches contacts, relays, or other control devices), in which at least one of the wind circuit unit, the air stream control unit, and the electrical unit is formed separately, and the one unit and the remaining units of the plurality of units are mutually assembled integrally to form the outdoor unit.

An assembling method of the separate type air conditioner of the invention comprises (a) a step of assembling an outdoor unit, and (b) a step of assembling an indoor unit consisting of a plurality of units, that is, (i) a wind circuit unit having an air suction port, (ii) an air stream unit having an air diffuser, and (iii) an electrical unit having an electric control device. The indoor unit assembling step includes forming at least one of said units (i), (ii), and (iii) separately and then integrating units (i), (ii), and (iii) to form the indoor unit.

Preferably, the wind circuit unit has a heat exchanger and blowing means, the air stream control unit has air stream control means, and the electrical unit has an electric circuit.

Preferably, the indoor unit composed of the wind circuit unit, the air stream control unit, and the electrical unit has a front surface with a continuous pattern.

Preferably, the assembled indoor unit has a nearly rectangular parallelepiped shape.

Preferably, one surface of each one of the air circuit unit, the air stream control unit, and the electrical unit is positioned at the front side of the indoor unit.

Preferably, each part of the wind circuit unit, the air stream control unit, and the electrical unit is mutually formed separately, and the wind circuit unit, the air stream control unit, and the electrical unit are mutually assembled integrally by a fitting means or mounting jig to form the indoor unit.

Preferably, the wind circuit unit and the air stream control unit integrally form an inseparable first part, the first part and the electrical unit are mutually assembled integrally by a fitting means or mounting jig to form the indoor unit.

Preferably, the wind circuit unit and the electrical unit integrally form an inseparable second part, the second part and the air stream control unit are mutually assembled integrally by a fitting means or mounting jig to form the indoor unit.

Preferred embodiments of the invention are described below.

Exemplary embodiment 1

Figure 4:
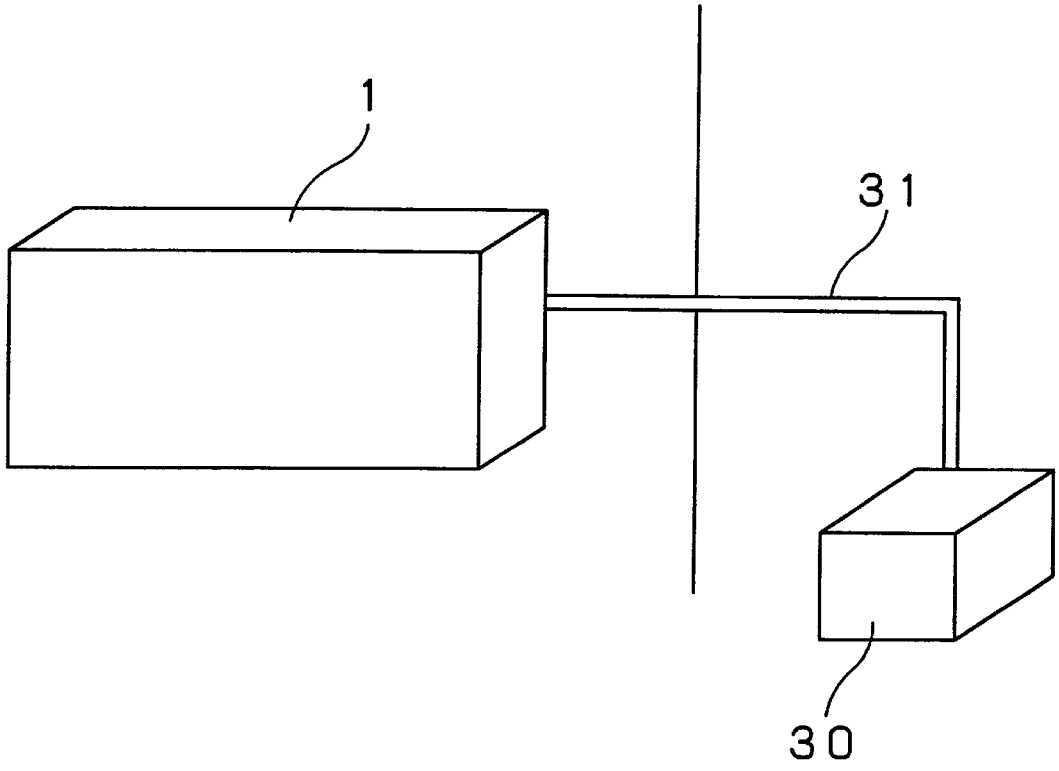
FIG. 4 is drawing showing a separate type air conditioner in accordance with an exemplary embodiment of the present invention.
Figure 5:
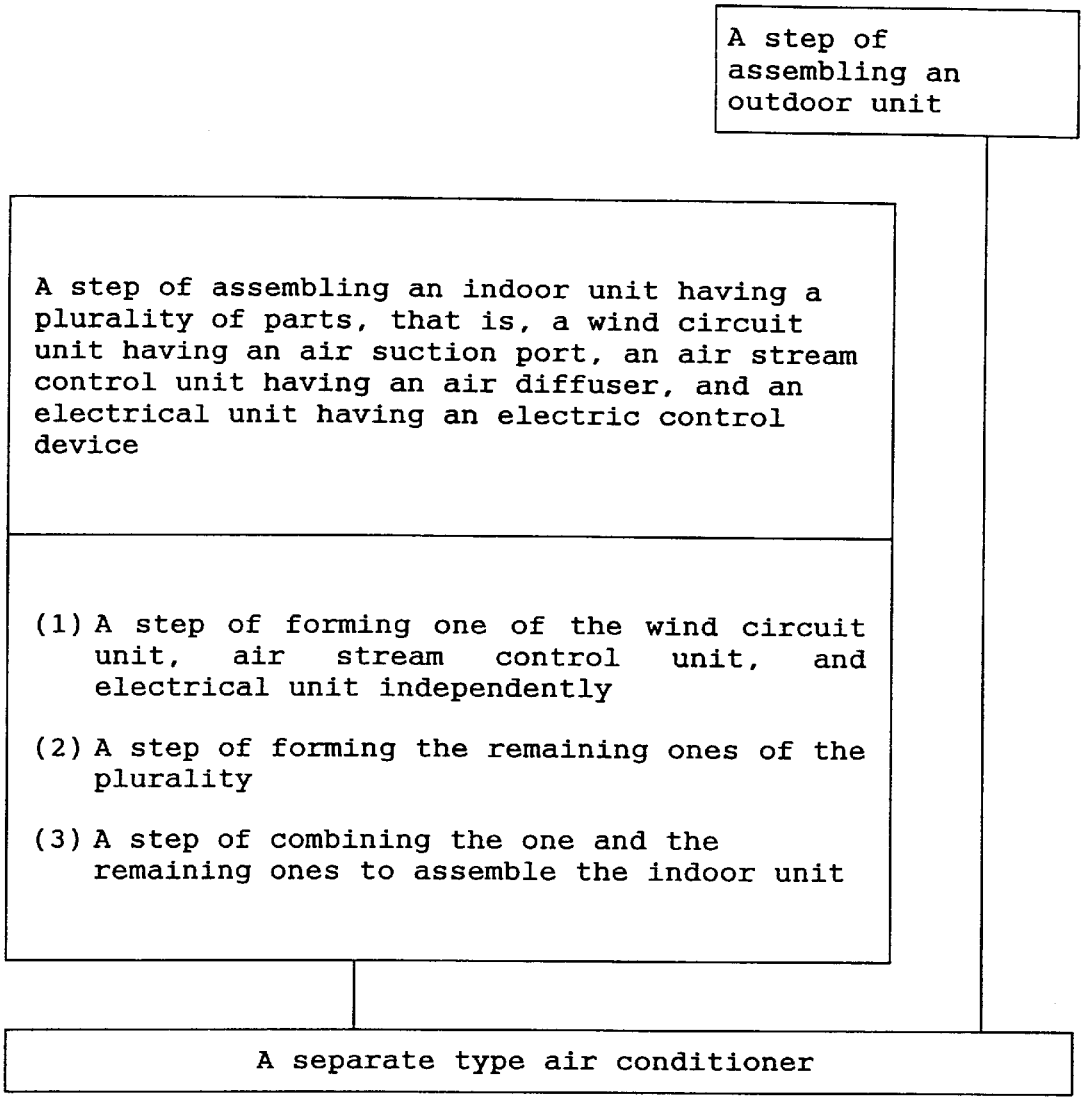
FIG. 5 is a process drawing showing the assembling method of a separate type air conditioner in accordance with an exemplary embodiment of the present invention.
Figure 6:
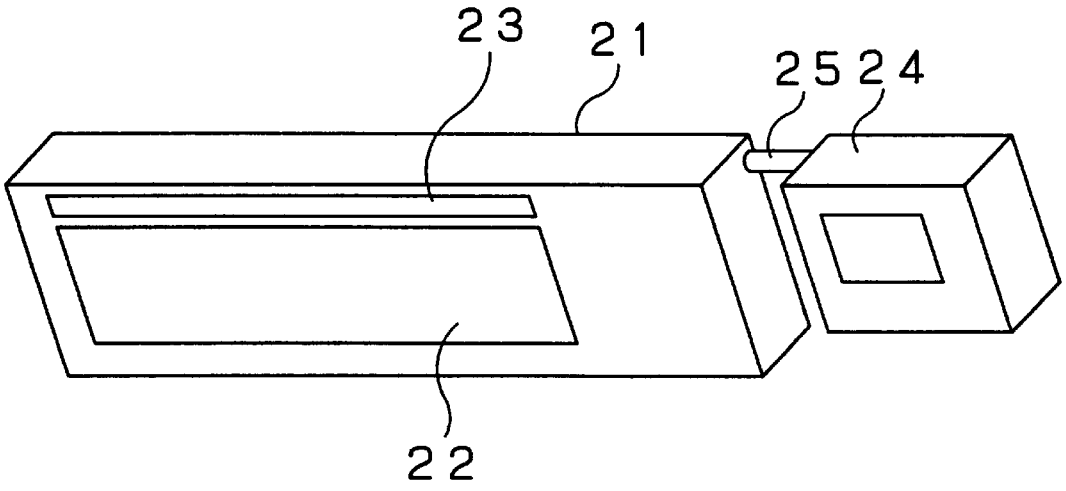
Fig. 6 PRIOR ART
FIG. 6 is a perspective view showing an indoor unit of a conventional separate type air conditioner.

The appearance of the separate type air conditioner in an exemplary embodiment of the invention is shown in FIG. 1(*a*), FIG. 1(*b*), and FIG. 4. FIG. 1(*a*) shows a separate state of the units, and FIG. 1(*b*) shows an assembled state of the units. A process drawing showing an assembling method of a separate type air conditioner of the invention is shown in FIG. 5. The separate type air conditioner comprises an outdoor unit 30 installed outdoors, and an indoor unit 1 installed indoors. The outdoor unit 30 and the indoor unit 1 are connected through external piping 31. The indoor unit 1 includes a refrigeration cycle unit (not shown), a wind circuit unit 2, an air stream control unit 3, and an electrical unit 4. The refrigeration cycle unit includes a heat exchanger (not shown) and piping (not shown) for circulating the refrigerant. The wind circuit unit 2 takes in air through an air suction port 2*a* and the air is blown using a blowing means (not shown) such as a blower. The air stream control unit 3 controls the stream of air out of the indoor unit and includes air stream control means, such as a vertical blade 3*a* and a lateral blade 3*b*, and an air diffuser 3*c*. The electrical unit 4 has an electric circuit and an electric control device. The wind circuit, unit 2 may also contain the refrigeration cycle.

The wind circuit unit 2, air stream control unit 3 and electrical unit 4 are mutually separable. That is, these three units are formed independently from each other. Each one of these three units has a nearly rectangular parallelepiped shape. As shown in FIG. 1(*a*), the upper surface of the air stream control unit 3 is combined with the lower surface of the wind circuit unit 2. The left side of the electrical unit 4 is combined with the right side of the wind circuit unit 2 and air stream control unit 3. In this case, the indoor unit 1 composed of the wind circuit unit 2, air stream control unit 3, and electrical unit 4 possesses a front surface having a continuous pattern. Further, the assembled indoor unit 1 has a nearly rectangular parallelepiped shape. Moreover, one surface of each one of the wind circuit unit 2, air stream control unit 3, and electrical unit 4 is positioned at the front side of the indoor unit. Thus, the indoor unit 1 is assembled.

Each unit is assembled by a fitting means such as a fitting pawl provided in each unit or assembled using a mounting jig such as a screw. The assembled indoor unit 1 can be detachably mounted on the room wall.

In this constitution, by manipulating the electrical unit 4, the electric control device is put in action, the outdoor unit 30 and indoor unit 1 are driven, and the refrigeration cycle operates. The indoor air is sucked into the wind circuit unit 2 from the air suction port 2*a*. The air is cooled or heated by the heat exchanger, and converted to a specified temperature. The air converted to the specified temperature is blown out in a specified direction in the room from the air diffuser 3*c* of the air stream control unit 3 by the action of an air stream control means such as a vertical blade 3*a* or a lateral blade 3*b*. Thus, the air in the room is conditioned.

Exemplary embodiment 2

Figure 2A:
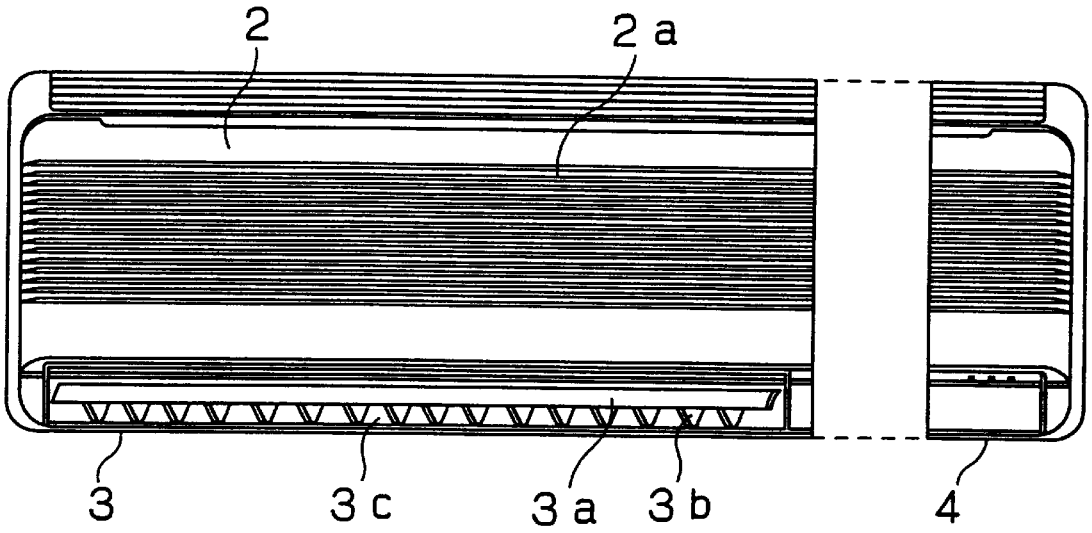
FIG. 2(*a*) and FIG. 2(*b*) are drawings showing an indoor unit in accordance with an exemplary embodiment of the present invention, in which FIG. 2(*a*) shows separate units, and FIG. 2(*b*) shows assembled units.
Figure 2B:
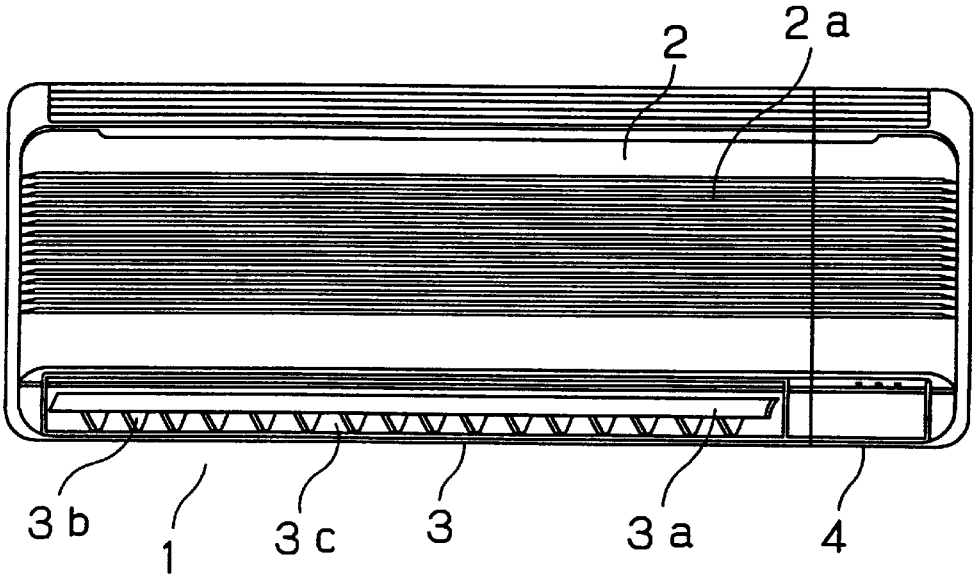

The appearance of the separate type air conditioner in an embodiment of the invention is shown in FIG. 2(*a*), FIG. 2(*b*), and FIG. 4. FIG. 2(*a*) shows a separate state of the units, and FIG. 2(*b*) shows an assembled state of the units. A process drawing showing an assembling method of separate type air conditioner in an embodiment of the invention is shown in FIG. 5. The separate type air conditioner comprises an outdoor unit 30 installed outdoors, and an indoor unit 1 installed indoors. The outdoor unit 30 and the indoor unit 1 are connected through an external piping 31. The indoor unit 1 includes a refrigeration cycle unit (not shown), a wind circuit unit 2, an air stream control unit 3, and an electrical unit 4. The refrigeration cycle unit includes a heat exchanger (not shown) and piping (not shown) for circulating the refrigerant. The wind circuit unit 2 takes in air through an air suction port 2*a* and the air is blown using a blowing means (not shown) such as a blower. The air stream control unit 3 controls the stream of air out of the indoor unit and includes air stream control means such as a vertical blade 3*a* and a lateral blade 3*b*, and an air diffuser 3*c*. The electrical unit 4 has an electric circuit and an electric control device. The wind circuit unit 2 may also contain the refrigeration cycle.

The wind circuit unit 2 and air stream control unit 3 are integrally formed as an inseparable first part, and the electrical unit 4 is formed independently of this first part. As shown in FIG. 2(*a*), the left side of the electrical unit 4 is combined with the right side of the integrally formed air stream control unit 3 and wind circuit unit 2. In this case, the indoor unit 1 composed of the wind circuit unit 2, air stream control unit 3, and electrical unit 4 possesses a front surface having a continuous pattern. Further, the assembled indoor unit 1 has a nearly rectangular parallelepiped shape. Moreover, one surface of each one of the wind circuit unit 2, air stream control unit 3, and electrical unit 4 is positioned at the front side of the indoor unit. Thus, the indoor unit 1 is assembled.

Each unit is assembled by a fitting means such as a fitting pawl provided in each unitor assembled using a mounting jig such as a screw. The assembled indoor unit 1 can be detachably mounted on the room wall.

Exemplary embodiment 3

Figure 3A:
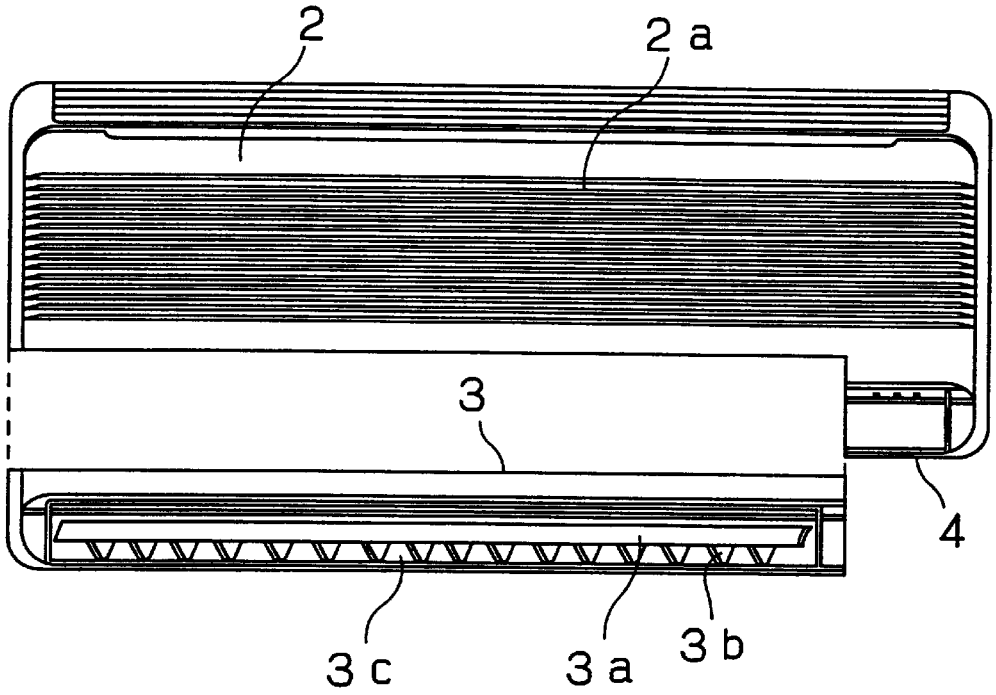
FIG. 3(*a*) and FIG. 3(*b*) are drawings showing an indoor unit in accordance with an exemplary embodiment of the present invention, in which FIG. 3(*a*) shows separate units, and FIG. 3(*b*) shows assembled units.
Figure 3B:
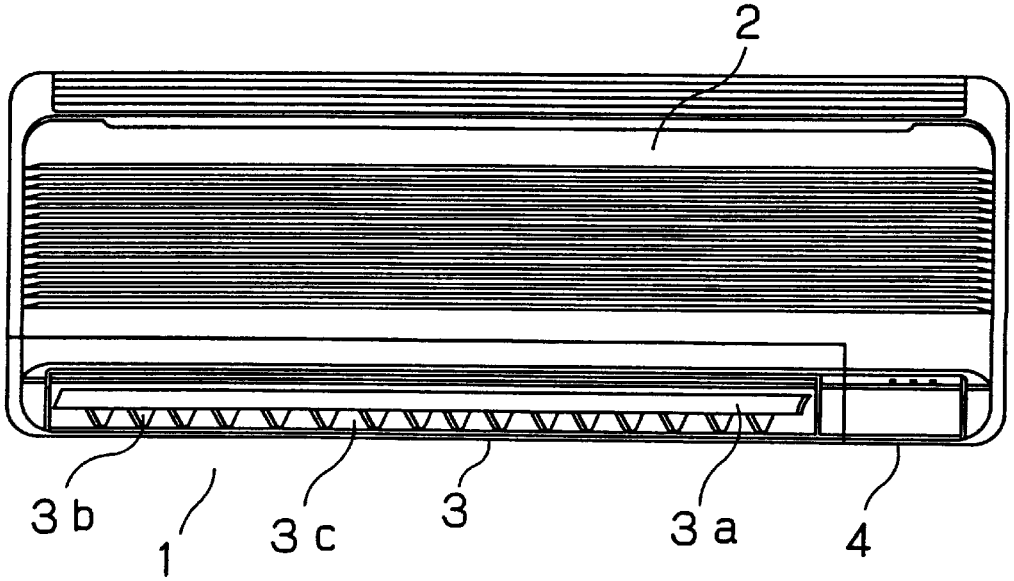

The appearance of the separate type air conditioner in an embodiment of the invention is shown in FIG. 3(*a*), FIG.

3(*b*), and FIG. 4. FIG. 3(*a*) shows a separate state of the units, and FIG. 3(*b*) shows an assembled state of the units. A process drawing showing an assembling method of separate type air conditioner in an embodiment of the invention is shown in FIG. 5. The separate type air conditioner comprises an outdoor unit 30 installed outdoors, and an indoor unit 1 installed indoors. The outdoor unit 30 and the indoor unit 1 are connected through an external piping 31. The indoor unit 1 includes a refrigeration cycle unit (not shown), a wind circuit unit 2, an air stream control unit 3, and an electrical unit 4. The refrigeration cycle unit includes a heat exchanger (not shown) and piping (not shown) for circulating the refrigerant. The wind circuit unit 2 takes in air through an air suction port 2*a* and the air is blown using a blowing means (not shown) such as a blower. The air stream control unit 3 controls the stream of air out of the indoor unit and includes air stream control means such as a vertical blade 3*a* and a lateral blade 3*b*, and an air diffuser 3*c*. The electrical unit 4 has an electric circuit and an electric control device. The wind circuit unit 2 may also contain the refrigeration cycle.

The wind circuit unit 2 and electrical unit 4 are integrally formed as an inseparable first part, and the air stream control unit 3 is formed independently of this first part. As shown in FIG. 3(*a*), the right side and upper side of the air stream control unit 3 are combined with the left side and lower side of the integrally formed electrical part 4 and wind circuit unit 2. In this case, the indoor unit 1 composed of the wind circuit unit 2, air stream control unit 3, and electrical unit 4 possesses a front surface having a continuous pattern. Further, the assembled indoor unit 1 has a nearly rectangular parallelepiped shape. Moreover, one surface of each one of the wind circuit unit 2, air stream control unit 3, and electrical unit 4 is positioned at the front side of the indoor unit. Thus, the indoor unit 1 is assembled.

Each unit is assembled by a fitting means such as a fitting pawl provided in each unit or assembled using a mounting jig such as a screw. The assembled indoor unit 1 can be detachably mounted on the room wall.

In the foregoing embodiment 1 to embodiment 3, the shape of the indoor unit 2 is nearly rectangular parallelepiped, but not limited to this shape, it may be formed in any desired front shape such as circular, elliptical or polygonal shape. The indoor unit 1 has three units, that is, the wind circuit unit 2, air stream control unit 3, and electrical unit 4, but is not limited to such constitution. For example, the indoor unit 1 may be divided into three or more parts, and each separated part may be assembled to compose the indoor unit. Moreover, each unit of the separated wind circuit unit 2, air stream control unit 3, and electrical unit 4 has a nearly rectangular parallelepiped shape, but the shape of each divided part is not limited to this shape alone, and it may be formed in any desired front shape such as circular, elliptical or polygonal shape, and the shape of these engaging parts is preferred to coincide with each other.

In this constitution, it is possible to obtain an indoor unit of an air conditioner having such effects as excellent appearance, small number of parts, enhanced ease of disassembling, excellent working efficiency in mounting, and excellent working efficiency in repair service. Moreover, without sacrificing the outlook of the merchandise on the whole, these excellent effects are obtained. In model changeover, by modifying the individual units of the wind circuit unit, air stream control unit and electrical unit according to the purpose, restyling is easier. Hence, expenses for making dies for producing the units are saved, so that the manufacturing cost is reduced.

What is claimed is:

1. A separate type air conditioner comprising:

(a) an outdoor unit, and (b) an indoor unit including (i) a wind circuit unit having an air suction port, (ii) an air stream control unit having an air diffuser, and (iii) an electrical unit having an electric control device, wherein at least one of said wind circuit unit, said air stream control unit and said electrical unit said is formed separately, by itself and wherein said wind circuit unit, said air stream control unit and said electrical unit are assembled together to form said indoor unit.

2. A separate type air conditioner of claim 1, wherein said wind circuit unit has a heat exchanger and blowing means, said air stream control unit has air stream control means, and said electrical unit has an electric circuit.

3. A separate type air conditioner of claim 1, wherein said indoor unit has a front surface with a continuous pattern.

4. A separate type air conditioner of claim 1, wherein said indoor unit has a nearly rectangular parallelepiped shape.

5. A separate type air conditioner of claim 1, wherein said indoor unit has a nearly rectangular parallelepiped shape, and one surface of each of said air circuit unit, said air stream control unit, and said electrical unit is positioned at the front side of said indoor unit.

6. A separate type air conditioner of claim 1, wherein said wind circuit unit, said air stream control unit, and said electrical unit are formed separately, and said wind circuit unit, said air stream control unit, and said electrical unit are assembled integrally by a fitting means or a mounting jig to form said indoor unit.

7. A separate type air conditioner of claim 1, wherein said wind circuit unit and said air stream control unit integrally form an inseparable first part, and said first part and said electrical unit are assembled integrally by aa fitting means or a mounting jig to form said indoor unit.

8. A separate type air conditioner of claim 1, wherein said wind circuit unit and said electrical unit integrally form an inseparable first part, and said first part and said air stream control unit are assembled integrally by a fitting means or a mounting jig to form said indoor unit.

9. An assembling method of separate type air conditioner comprising the steps of:

(a) assembling an outdoor unit, and (b) assembling an indoor unit comprising, (i) a wind circuit unit having an air suction port, (ii) an air stream unit having an air diffuser, and (iii) an electrical unit having an electric control device, (1) independently forming at least one of said said wind circuit unit, said air stream control unit, and said electrical unit separately, and (2) assembling integrally said wind circuit unit, said air stream unit and said electrical unit.

10. An assembling method of separate type air conditioner of claim 9, wherein said wind circuit unit has a heat exchanger and blowing means, said air stream control unit has air stream control means, and said electrical unit has an electric circuit.

11. An assembling method of separate type air conditioner of claim 9, wherein said wind circuit unit, said air stream control unit, and said electrical unit are assembled so as to form said indoor unit having a front surface with a continuous pattern.

12. An assembling method of separate type air conditioner of claim 9, wherein said wind circuit unit, said air stream control unit, and said electrical unit are assembled so as to form said indoor unit having a nearly rectangular parallelepiped shape.

13. An assembling method of separate type air conditioner of claim 9, wherein said step (1) comprises forming said wind circuit unit, said air stream control unit, and said electrical unit independently from each other, and wherein said step (2) of assembling said units with a fitting means or a mounting jig to form said indoor unit.

14. An assembling method of separate type air conditioner of claim 9, wherein said step (1) comprises forming said electrical unit independently of said wind circuit unit and said electrical unit, and forming said wind circuit unit and said air stream control unit integrally into an inseparable first part, and wherein said step (2) of assembling said three units comprises a fitting means or a mounting jig to form said indoor unit.

15. An assembling method of separate type air conditioner of claim 9, wherein said step (1) comprises forming said air stream control unit independently of said wind circuit unit and said electrical unit, and forming said wind circuit unit and said electrical unit integrally into an inseparable first part, and said step (2) of assembling said three units comprises a fitting means or a mounting jig to form said indoor unit.

* * * * *